US005102144A

United States Patent [19]

Dickerman

[11] Patent Number: 5,102,144

[45] Date of Patent: Apr. 7, 1992

[54] PROFIT AND LOSS GAME APPARATUS

[76] Inventor: Rodney W. Dickerman, 3 Tulip Ave., Granite, Ill. 62040

[21] Appl. No.: 640,613

[22] Filed: Jan. 14, 1991

[51] Int. Cl.[5] ..... A63F 3/00

[52] U.S. Cl. ..... 273/241; 273/237

[58] Field of Search ..... 273/241, 237, 243, 256

[56] References Cited

U.S. PATENT DOCUMENTS

| | | | |
|---|---|---|---|
| 3,030,112 | 4/1962 | Scharp | 273/241 |
| 4,119,319 | 10/1978 | Goldfarb | 273/237 |
| 4,477,080 | 10/1984 | Baker | 273/241 |
| 4,648,601 | 3/1987 | Carmichael | 273/241 |
| 4,666,162 | 5/1987 | Campbell | 273/241 |
| 4,696,476 | 9/1987 | Eplett | 273/241 |
| 4,838,557 | 6/1989 | Floyhar | 273/237 |
| 5,004,245 | 4/1991 | Schumacher | 273/241 |

FOREIGN PATENT DOCUMENTS

| | | | |
|---|---|---|---|
| 218607 | 2/1910 | Fed. Rep. of Germany | 273/241 |
| 2226767 | 7/1990 | United Kingdom | 273/241 |
| 2228422 | 8/1990 | United Kingdom | 273/241 |
| 2229099 | 9/1990 | United Kingdom | 273/241 |

*Primary Examiner*—Edward M. Coven
*Assistant Examiner*—William E. Stoll
*Attorney, Agent, or Firm*—Leon Gilden

[57] ABSTRACT

The game of the invention including a multi-tiered board of a plurality of perhipheral and parallel paths, each arranged in an ascending organization. The paths are defined by contrasting colored spaces, with directional cards utilized at the culmination of each player's turn to effect directing of individuals in attaining and losing various denominations of simulated money. Termination of play by each player directed to a finish space terminates the game, wherein the players compare money attained to ascertain a winner. A modification of the board includes the board defined with an internal cavity to receive illumination members therewithin, with the board formed of translucent material. Modified tokens utilized include an upper conical member formed of a light polarizing material mounted on a base, wherein the upper member is rotatable relative to the lower member to indicate various positioning of each token relative to each path.

2 Claims, 4 Drawing Sheets

PRIOR ART

PROFIT AND LOSS GAME APPARATUS

BACKGROUND OF THE INVENTION

1. Field of the Invention

The field of invention relates to board games, and more particularly pertains to a new and improved profit and loss game apparatus wherein the same is arranged for simulation of profit and loss in a business-like and entertainment scenario.

2. Description of the Prior Art

Various board games have been utilized in the prior art for educational and amusement purposes. The instant invention sets forth an organization wherein various tokens are directed about a board, with the tokens utilized to enhance a visual and entertaining effect in their traverse of the board. A multi-tiered board may be found in U.S. Pat. No. 4,696,476.

It mat be appreciated therefore that the profit and loss game apparatus of the instant invention sets forth an organization to permit enjoyment and entertainment in a multi-tiered board game while simulating profit and loss in a life-cycle type simulation.

SUMMARY OF THE INVENTION

In view of the foregoing disadvantages inherent in the known types of board games now present in the prior art, the present invention provides a profit and loss game apparatus wherein the same effects simulation of monetary losses and gains during a simulated arrangement of events relative to real-life scenarios. As such, the general purpose of the present invention, which will be described subsequently in greater detail, is to provide a new and improved profit and loss game apparatus which has all the advantages of the prior art board games and none of the disadvantages.

To attain this, the present invention provides a game including a multi-tiered board of a plurality of peripheral and parallel paths, each arranged in an ascending organization. The paths are defined by contrasting colored spaces, with directional cards utilized at the culmination of each sequentially arranged player's turn to effect directing of individuals in attaining and losing various denominations of simulated money attainment. Termination of play by each player directed to a finish space terminates the game, wherein the players compare money attained to ascertain a winner. A modification of the board includes the board defined with an internal cavity to receive illumination members therewithin, with the board formed of translucent material. Modified tokens utilized include an upper conical member formed of a light polarizing material mounted on a base, wherein the upper member is rotatable relative to the lower member to indicate various positioning of each token relative to each path.

My invention resides not in any on of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved profit and loss game apparatus which has all the advantages of the prior art board games and none of the disadvantages.

It is another object of the present invention to provide a new and improved profit and loss game apparatus which may be easily and efficiently manufactured and marketed.

It is a further object of the present invention to provide a new and improved profit and loss game apparatus which is of a durable and reliable construction.

An even further object of the present invention is a provide a new and improved profit and loss game apparatus which is susceptible of a low cost of manufacture with regard to both materials and labor, and which accordingly is then susceptible of low prices of sale to the consuming public, thereby making such profit and loss game apparatus economically available to the buying public.

Still yet another object of the present invention is to provide a new and improved profit and loss game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3*a* is an enlarged top orthographic view illustrating contrasting colored spaces of the game board.

DESCRIPTION OF THE PREFERRED EMBODIMENT

Figure 1:
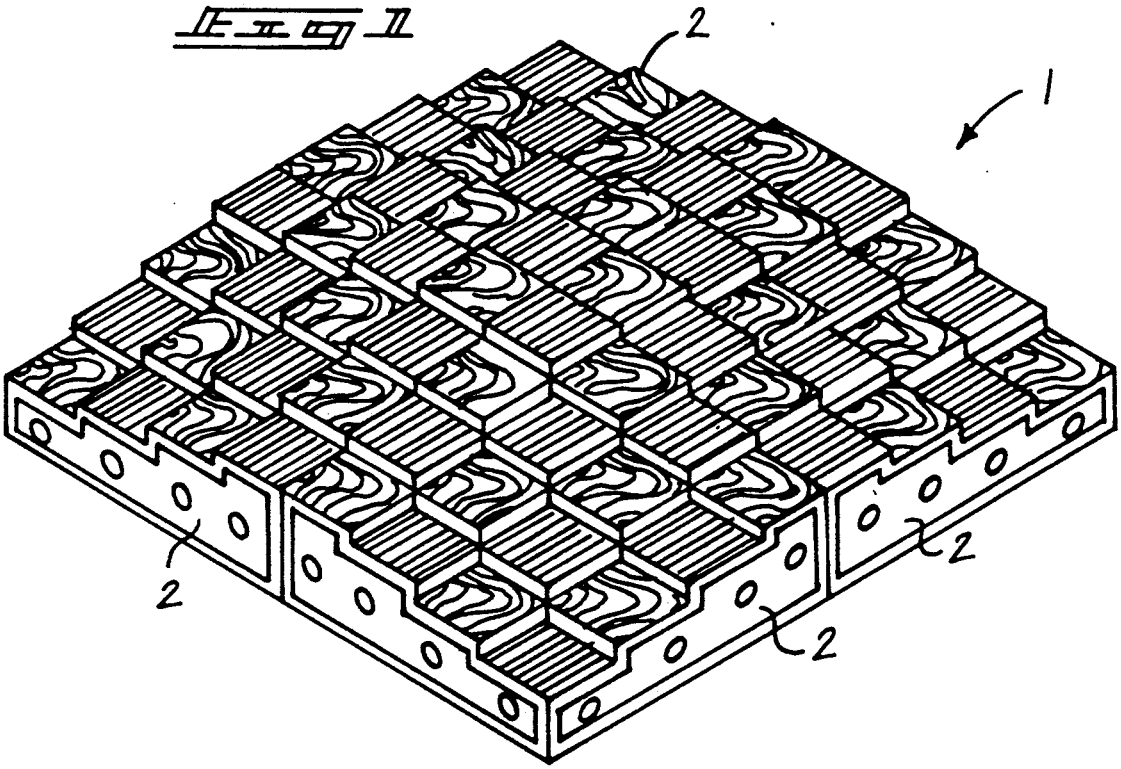
FIG. 1 is an isometric illustration of a prior art multi-tiered game board in a first orientation.

With reference now to the drawings, and in particular to FIGS. 1 to 7 thereof, a new and improved profit and loss game apparatus embodying the principles and concepts of the present invention and generally designated by the reference numerals 10–35 will be described.

Figure 2:
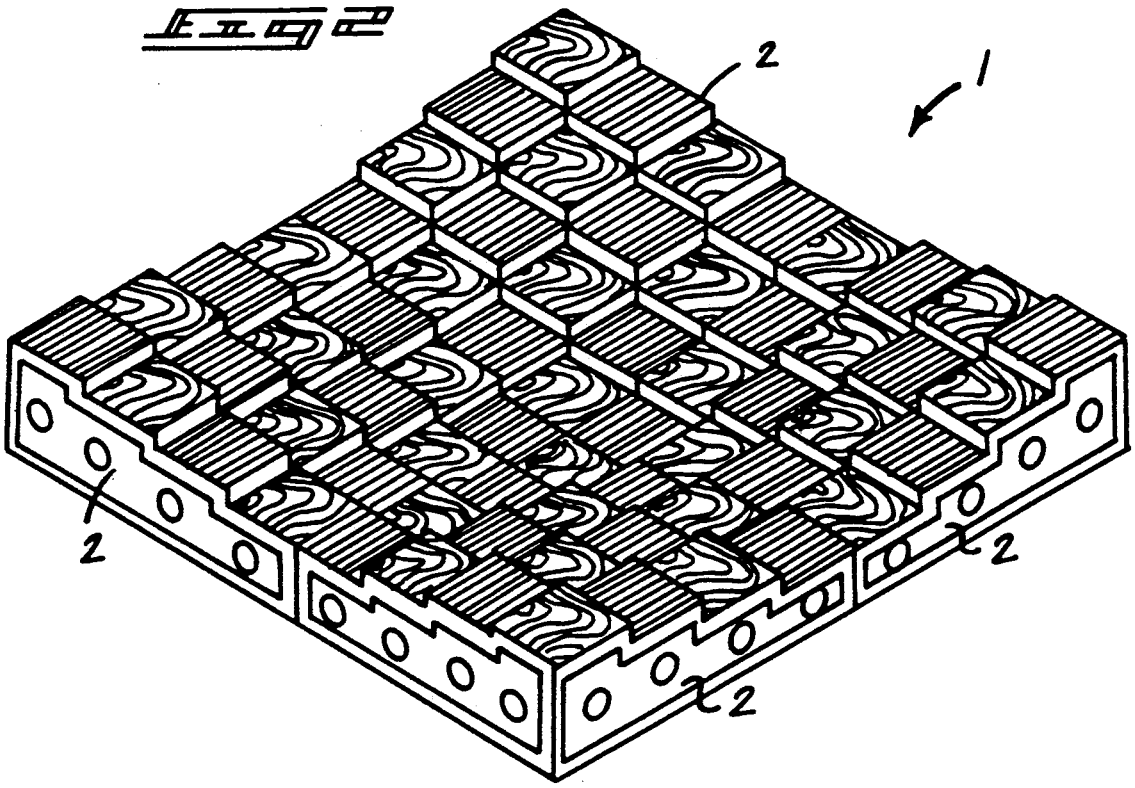
PRIOR ART FIG 2
FIG. 2 is an isometric illustration of the multi-tiered game board of FIG. 1 in a further orientation.
Figure 3:
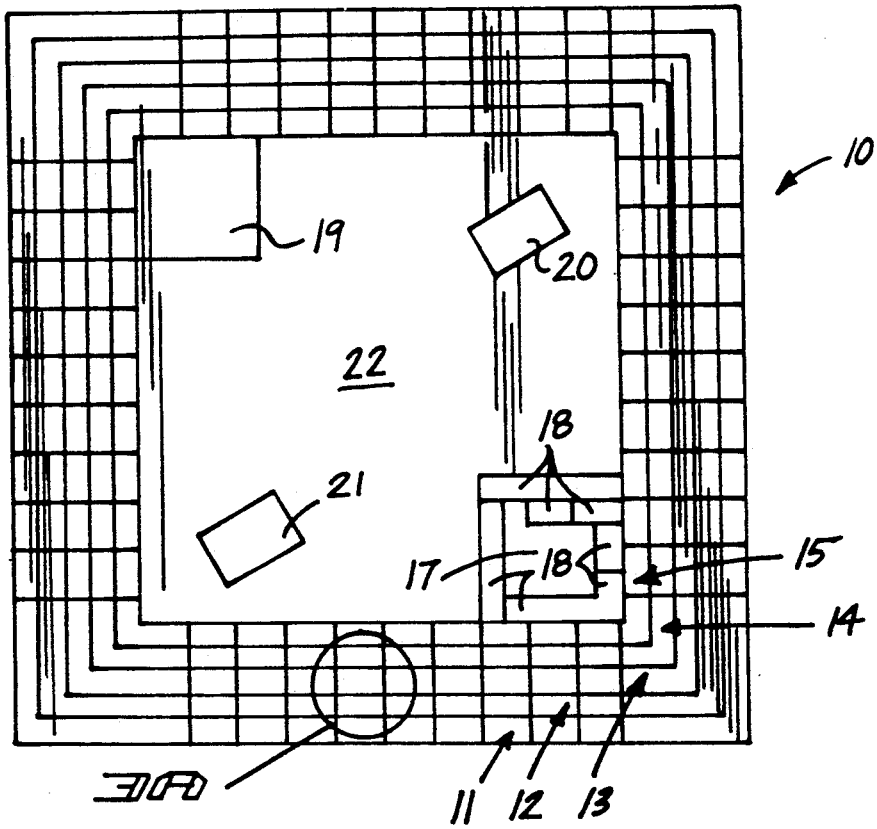
FIG. 3 is a top orthographic view of the game board of the instant invention.
Figure 30A:
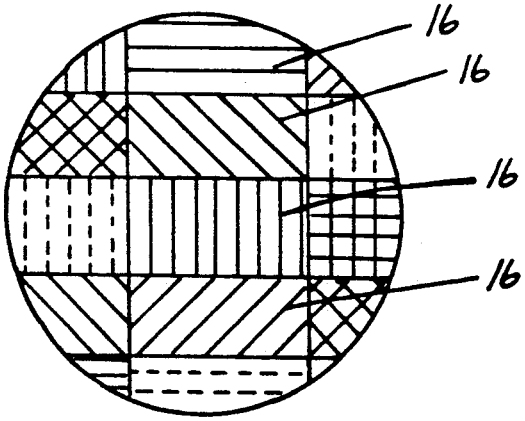
Figure 4:
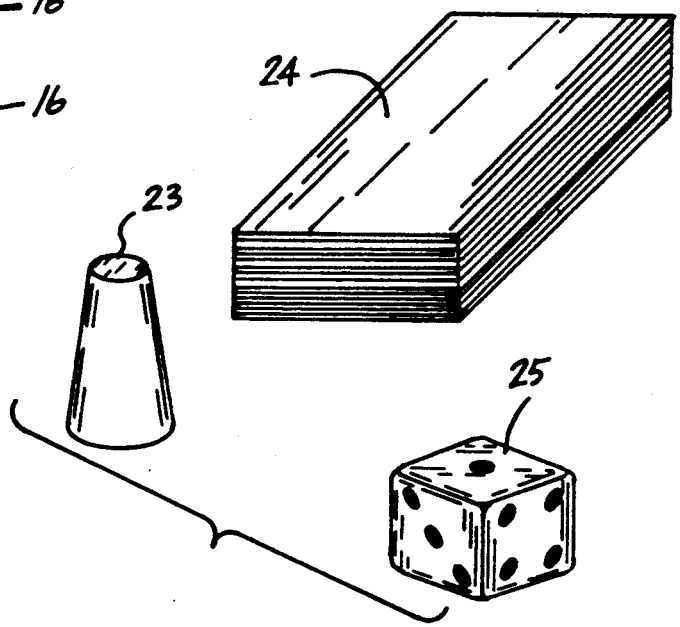
FIG. 4 is an isometric illustration of various components utilized by the instant invention in the play thereof.

FIGS. 1 and 2 illustrate the use of a prior art multi-tiered board structure, as set forth in U.S. Pat. No. 4,696,476, wherein a plurality of board sections 2 of the game organization 1 are manipulatable relative to one another to provide various levels of the various spaces of the board.

More specifically, the profit and loss game apparatus of the instant invention essentially comprises a multi-tiered game board 10 that includes a plurality of peripherally arranged paths defined by a first peripheral path 11 spaced from and parallel a second peripheral path 12, spaced from and parallel a third peripheral path 13, spaced from and parallel a fourth peripheral path 14, and spaced from and parallel a fifth peripheral path 15. Each of the paths 11–15 are in an ascending level of elevation relative to one another for enhanced visual effect of various positions of individual players and their progress relative to other such players utilizing respective tokens 23 to represent each player as the player traverses the paths 11–15 along contrasting, multi-colored adjacent path spaces 16. A finishing space 17 is arranged subsequent to a player traversing a predetermined number of steps 18. The various elevational orientations of the steps and paths are arranged to provide entertainment and visual indication of players and their relative positions throughout the game. A lottery space 19 is arranged in a diagonal orientation relative to the finishing space 17 for containment of various lottery monies, to be described in more detail below in an aspect and play of the game. A first and second playing card space 20 and 21 mount cards 24 in the first space and their discarding in the second space in play of the game. The directional cards 24 are utilized at the termination of each player's turn, which is effected by a roll of the die member 25 to traverse a predetermined number of the spaces 16.

In start of the game, each player rolls the die member 25 twice. The first roll indicates what an individual's pay day is. A pay day is defined by a respective pay day card, wherein six pay day cards are provided within the directional cards 24. In roll of the dice, as a six-sided die is utilized, a roll of the number 1 indicates a pay day of $500.00. Similarly, a roll of the number 2 indicates $625.00; a roll of the number 3 indicates $700.00; a roll of the number 4 indicates $800.00; a roll of the number 5 indicates $900.00; and a roll of the number 6 indicates $1,000.00 to be paid to a respective player. The second roll of the die member is for indication of players and their sequential taking of turns in play of the game.

BANKRUPTCY

In a bankruptcy procedure where a player is relatively devoid of money or allegations that exceed those of assets, a player randomly selects a number from 1–6 and rolls the die member 25. A player receives two chances, whereupon a player selecting five rolls of five,.the player wins. If a player rolling a three after selecting five must then roll a two to attain the number preselected. A player selecting bankruptcy may continuing playing and that player forfeiting $150.00 of the pay day in lieu of their predetermined amount until that player picks a card that sets forth the player as "bankruptcy free". That player may then begin receiving regular pay days again. If a player picks a card that sets forth "new position roll dice", the player then rolls a die and the players pay day will be determined by the number in the die member 25. A "bankruptcy free card" must be paid for by the bankruptcy player in a predetermined amount such as $500.00.

GAMBLING

A player preselects a number randomly. The player's roll of the die member 25 is consistent with the number preselected, the player will receive 1,000 times the roll of the die. When a player is unsuccessful, the player must pay the bank (the bank being a preselected player) 1,000 times the roll of the die. Within the cards 24 there are twenty "gamble cards". The player that selects this card may play it or pass it to a player of his choice. When the player passes a card, the player that receives the card is obligated to play the card. The player playing the card upon winning receives 100 times the roll of the die from the player that passed the card. If the player that receives the card losses, the player must pay the passer of the card ten times the roll of the die member 25.

IRS AUDIT

There are ten such audit cards within the stack 24. The player has a choice of even or odd numbers on the die 25. IRS will pay 100 times the roll of die and the player will pay ten times the roll of the die should the player being correct in a selection of an odd or even number of the die number. There are ten IRS audit cards within the card stack to be used in conjunction with the ten "bankruptcy free cards". In selection of an "IRS audit card", the player is then required to select an odd or even roll of the die and to receive 100 times the roll of the die from the IRS (the bank) or pay ten times the roll of the die 25 to the IRS, or mores specifically the bank.

INSURANCE CARD

At the outset of the game, a player may buy insurance cards for $500.00. During play of the game, the player must pay $1,000.00 for the same card. Upon selection of a definite family card, the bank pays 100 times the roll of the die upon a player having an insurance card, with six insurance cards being available in the deck or stack of directional cards 24. Further, there are four definite "family cards" being available within the deck.

LOTTERY

There are a variety of lottery cards available within the deck, wherein a player selecting a "pay lottery cards" selects from several categories, with five cards setting forth that the player must pay $50.00 into the lottery space 19, five more cards where the player must pay $150.00 into the space 19, five cards where the player must pay $100.00, four cards where the player must pay $200.00, two cards where the player must pay $500.00 and one card where the player must pay $1,000.00. A player in play of the lottery upon the selection of a lottery type pay card, rolls the die wherein a one or three wins $2,500.00, a two or four wins $4,500.00, a five wins $7,000.00, and a six wins the lottery jackpot, wherein the player sees all the money in the pot less than $25,000.00. Further, various cards such as "collect cards" are available, five cards from $100.00 to $1,000.00, wherein a player collects $200.00 from a player to the right or left of the player selecting the card. A collect card sets forth that a player may collect $200.00 from each player. There are four categories of cards where a player must pay ten percent of that player's "pay day" to a player to the right and another four cards where directions are indicated that a moving player must pay $100.00 to each player within the game. There are further four cards directed to a baseball pool where a moving player rolls the die member 25 and collects $100.00 times an indicated odd number indicated upon rolling of the die member 25. Upon an even number being indicated by the die member 25, the moving player must pay all members 100 times the roll of the die.

Figure 5:
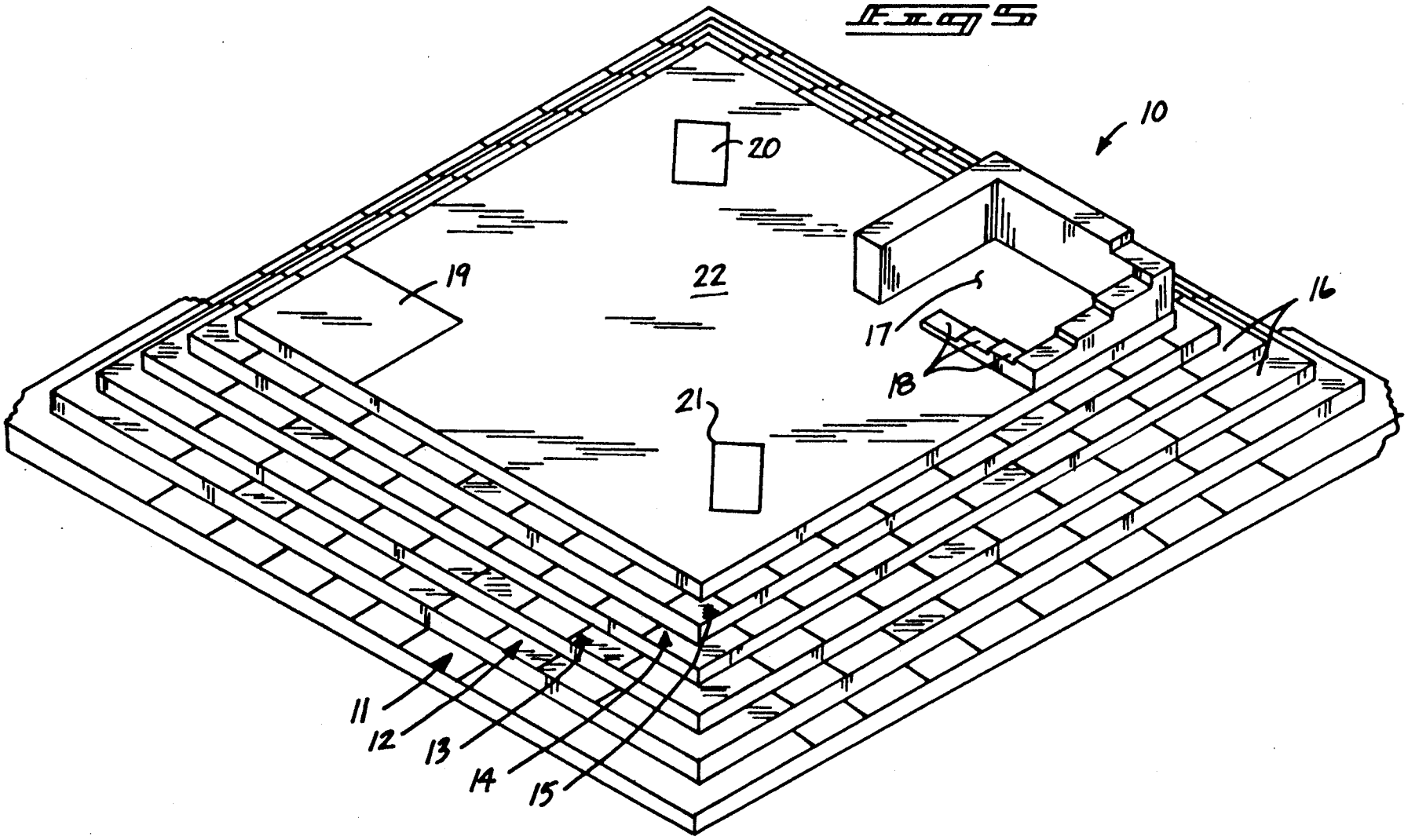
FIG. 5 is an isometric illustration of the game board of the instant invention.
Figure 6:
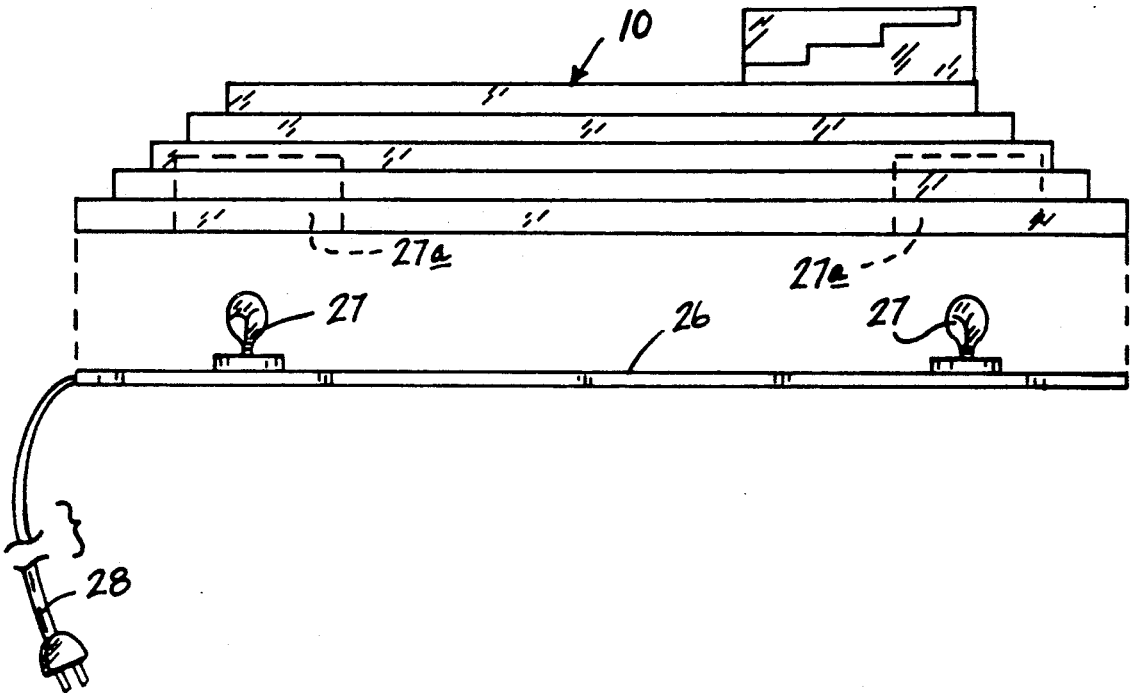
FIG. 6 is an orthographic side view of the game board of the instant invention in association with an underlying lighting organization.
Figure 7:
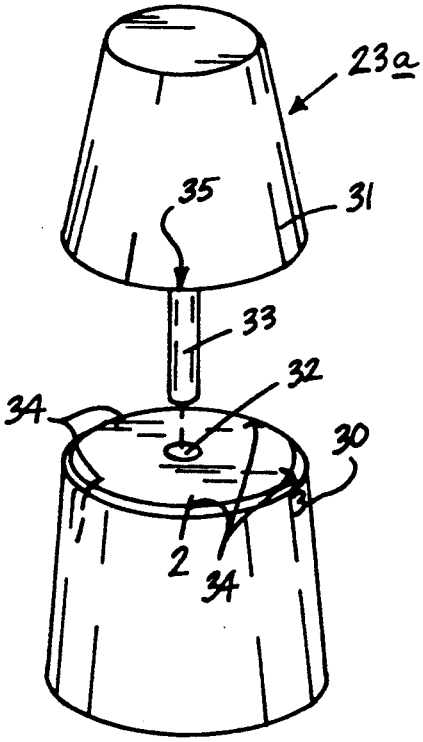
FIG. 7 is an isometric illustration of a modified playing token utilized by the instant invention.

The board 10 as indicated is of a multi-tiered configuration, wherein FIGS. 5 and 6 illustrate the use of a translucent board formed with a plurality of light-receiving cavities 27*a* to receive luminescent light member 27 therewithin powered by the power supply cord 28. As indicated, the translucency is directed through each of the multi-colored spaces 16. Further, a modified player token 23*a* (see FIG. 7) is utilized, wherein a lower conical base is transparent and is formed with a coaxially directed bore 32 to receive a translucent peg 33 mounted coaxially to an upper conical member 31 formed of a polarizing material. The member 25 includes an upper indicator 35 positionable with one of a plurality of five positions 34. The positions 1–5 of the plurality of positions 34 is aligned with the indicator 35 upon a player being within the respective first through fifth paths 11–15 respectively. In this manner, the token is formed with differing light hues than those of those in a different path. For example, a player in the first path 11 will be provided with a coloring hue by the upper end member 31 being oriented in the position 1 relative to a player in the second path 12 being formed with the token and the upper end member 31 in the second position of the multi-positions 34.

As the players terminate their traverse of the paths 11–15 and are within the finishing space 17, the player that has attained the greatest number of simulated dollar awards is declared the winner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A profit and loss game apparatus comprising, in combination, a game board, wherein the game board is formed with a plurality of individual tiered paths, each of the individual paths arranged adjacent one another and adjacent a peripheral border of the game board, with the paths arranged in an ascending order from the game board peripheral edge to a central planar surface of the game board, and the game board including a finishing space mounted within the central planar surface of the game board as a termination of movement throughout play of the game apparatus, and a plurality of tokens utilized for directing movement about each of the paths, and each of the paths formed of contrasting multi-colored path spaces, and a die member for indicating movement of the tokens throughout the spaces of the paths, and directional cards for directing loss or gain of simulated monetary values at a termination of each turn of each of a plurality of players, and wherein the game board is formed of translucent material, the game board including a plurality of cavities formed within the game board, and a light panel mounted to a bottom surface of the game board, with the light panel including a plurality of illumination members, with at least one illumination member receivable within each cavity for effecting illumination of the game board, and wherein each token includes a lower conical base receiving an upper conical member mounted thereon, the conical base including a central coaxial bore, and the upper conical member including a central coaxial peg receivable within the bore, and the base formed of a translucent material, and the upper member formed of a light polarizing material.

2. A game as set forth in claim 1 wherein the base includes a predetermined number of indicated positions equal to a predetermined number of paths of the plurality of paths, and the upper conical member including an upper indicator, wherein the upper indicator is sequentially positionable within each of the predetermined number of indicated positions upon a respective token traversing the predetermined number of paths sequentially.

* * * * *